US006152010A

United States Patent [19]

Mixon et al.

[11] Patent Number: 6,152,010

[45] Date of Patent: Nov. 28, 2000

[54] WIDE-AREA SLURRY MINE CLEARANCE

[75] Inventors: Larry Mixon, Panama City; Robert Woodall, Lynn Haven; Felipe Garcia, Panama City, all of Fla.

[73] Assignee: The United States of America as represented by the Secretary of the Navy, Washington, D.C.

[21] Appl. No.: 09/066,595

[22] Filed: Apr. 27, 1998

[51] Int. Cl.[7] ..... B64D 1/04

[52] U.S. Cl. ..... 89/1.13; 102/403

[58] Field of Search ..... 89/1.13, 1.11, 89/6.5, 1.55, 1.56, 28.05, 28.1; 102/402, 403, 289; 235/408

[56] References Cited

U.S. PATENT DOCUMENTS

| | | | |
|---|---|---|---|
| H162 | 11/1986 | Sullivan, Jr. et al. | 102/403 |
| 2,925,038 | 2/1960 | Walker | 89/1.13 |
| 3,638,569 | 2/1972 | Thomanek | 102/22 |
| 3,724,319 | 4/1973 | Zebelka et al. | 89/1.13 |
| 3,747,679 | 7/1973 | Roberts | 166/299 |
| 4,384,903 | 5/1983 | Enever | 149/34 |
| 4,542,941 | 9/1985 | Stromquist | 299/12 |
| 4,693,765 | 9/1987 | Stromquist et al. | 149/60 |
| 4,823,672 | 4/1989 | Eidelman | 89/1.13 |
| 4,967,636 | 11/1990 | Murray et al. | 89/1.13 |
| 5,174,384 | 12/1992 | Herman | 169/70 |
| 5,323,683 | 6/1994 | Dilhan et al. | 89/1.13 |
| 5,437,230 | 8/1995 | Harris et al. | 102/302 |
| 5,598,152 | 1/1997 | Scarzello et al. | 340/850 |
| 5,661,258 | 8/1997 | Garcia et al. | 102/402 |

*Primary Examiner*—Charles T. Jordan
*Assistant Examiner*—Jeffrey Howell
*Attorney, Agent, or Firm*—Harvey A. Gilbert

[57] ABSTRACT

A wide-area mine clearance device having a flexible hose that is extended through a suspected area of mines. An explosive composition slurry is pumped into and through the extended hose. A detonator is attached to the hose, after which the explosive composition in the hose may be detonated.

1 Claim, 3 Drawing Sheets

WIDE-AREA SLURRY MINE CLEARANCE

The invention described herein may be manufactured and used by or for the government of the United States of America for governmental purposes without the payment of any royalties thereon or therefor.

BACKGROUND OF THE INVENTION

1. Field of the Invention

The present invention generally relates to a device and method of clearing sea or land mines. More particularly, the device and method relates to clearing mines using slurry explosives. Most particularly, the slurry explosives are pumped into a flexible hose which has been extended into a minefield for wide-area mine clearance. The device and method may be used in military, humanitarian and/or administrative mine clearance operations.

2. Description of Related Art

The removal of mines is a particularly difficult endeavor. Mines are conventionally used to impede the progress of military forces through an area, either sea or land. Selective placement of the mines within an area is used to deny access into the area.

Mines are used to disrupt and demoralize military forces. Additionally, mines may be used to terrorize civilian populations. Mines vary in construction and armament, complicating any attempt to neutralize their use, commonly known as mine countermeasures. Significant problems occur when mine countermeasures do not reliably render an area safe for passage. The specter of a single active mine in an operational area may cause the cancellation of watercraft and/or troop movement into an area of conflict, or impede commercial and/or civilian traffic.

Within narrow sea lanes or in shallow waters, the threat of mines disrupts normal transit of ships and watercraft. Mines affecting sea-going vessels are particularly hazardous when placed in sea lanes and along coastal areas. Placement of mines within narrow sea lanes interrupts commercial flow of goods, and denies naval military vessels convenient, direct, and short transit routes through normal shipping channels. When placed along the shore or in sea lanes, mines can easily cause high casualty rates of troops engaged in amphibious operations, or warships transiting restricted waterways. On land, mines generally are located along known paths or other areas of convenient transit by vehicles or individuals to cause high casualty rates. Additionally, after a military conflict, residual mines remain hazardous to non-combatants and must be cleared during humanitarian or administrative mine clearing efforts. Accordingly, mine clearance needs to universally render all mines in an area inert to the incoming military forces, civilians or commerce, regardless whether the mines are at sea or on land.

Several approaches to mine clearance are known. U.S. Pat. No. 5,661,258 (Garcia et al.) discloses an air-delivered ordnance explosive. U.S. Pat. No. 5,598,152 (Scarzello et al.) discloses an underwater vehicle that detects possible mine locations and deposits mine-clearing explosives close-by. U.S. Pat. No. 5,437,230 (Harris et al.) discloses a standoff mine neutralization system using an unpowered air vehicle. U.S. Statutory Invention Registration no. H162 (Sullivan, Jr. et al.) discloses a system for wide-area mine clearance using multiple fuel containers.

Additionally, slurry explosive techniques are known. Slurry explosives are disclosed in U.S. Pat. No. 4,693,765 (Stromquist et al.). Additionally, U.S. Pat. No. 4,5422,941 (Stromquist) discloses transporting slurry explosives underground using a pipeline.

None of the prior techniques fully provide for the reliable clearance of sea and/or land mines for wide-areas along a given transit path. Several results are desired for mine clearance systems. First, a continuous path cleared of mines is needed for ship transit through sea channels and troop movement over land. Second, a device is needed which facilitates movement and handling of mine clearing equipment. Third, a two component explosive is desired, allowing transport of individual semi-inert components for safe handling, storage and transportation in wide-area mine clearance operations. Fourth, expedient deployment of mine clearing equipment is desired which facilitates large scale mine clearance. Fifth, a device which is simple to deploy and use is needed. Additionally, a low-cost, safe, and simple device which is directed to military, humanitarian and administrative mine clearance operations is desired.

In view of the foregoing, improvements in mine countermeasures have been desired. In addition to improved reliability of clearing mines, it has been desired to provide improved mine clearance over a wide-area.

SUMMARY OF THE INVENTION

The present invention provides a wide-area mine clearance device, comprising a flexible hose having a length sufficient to extend through a suspected area of mines and having a circumference capable of conducting a continuous detonation therethrough; a pump system attachable to the hose, the pump system having a pump capable of pumping an explosive composition into and through the extended hose, wherein the explosive composition fills the length of the hose; the explosive composition comprising a slurry having a solid explosive suspended in a fluidic carrier, the fluidic carrier being capable of transporting the solid explosive; means for extending the hose into and through a suspected area of mines; and, means for detonation of the explosive composition, wherein the explosive composition and hose are capable of conducting a continuous detonation therethrough.

The present invention further provides a method for wide-area mine clearance, comprising providing a wide-area mine clearance device comprising a flexible hose having a length sufficient to extend through a suspected area of mines and having a circumference capable of conducting a continuous detonation therethrough, a pump system attachable to the hose, the pump system having a pump capable of pumping an explosive composition into and through the extended hose, wherein the explosive composition fills the length of the hose, the explosive composition comprising a slurry having a solid explosive suspended in a fluidic carrier, the fluidic carrier being capable of transporting the solid explosive, means for extending the hose into and through a suspected area of mines, and, means for detonation of the explosive composition, wherein the explosive composition and hose are capable of conducting a continuous detonation therethrough; pumping gases into the hose wherein the hose extends into a possible mine field; pumping the explosive composition into and through the hose, wherein the explosive composition fills the length of the hose; and, detonating the explosive composition within the hose.

DETAILED DESCRIPTION OF THE PREFERRED EMBODIMENT

The present invention is a device for wide-area clearance of mines. Additionally, the invention is a method for deploying the device and a system of a plurality of the devices used in conjunction with each other. Wide-area mine clearance permits a clear path of transit for vessels at sea, transiting the littoral zone, or troops and/or vehicles on land. By reliably ensuring the absence of mines along a transit path, loss of life and destruction of valuable property may be avoided.

The device is designed for wide-area mine clearance of sea or land transit routes. Wide-area clearance permits lines of transit for large numbers of vessels, or troops and/or vehicles to pass through an area without the need for strict adherence of additional mine countermeasures. Accordingly, vessels, troops, vehicles and/or amphibious craft are able to proceed through sea lanes, land routes or along the shore which were previously suspected of containing mines, without excessive delays of transit or high risk of encountering mines.

Figure 1:
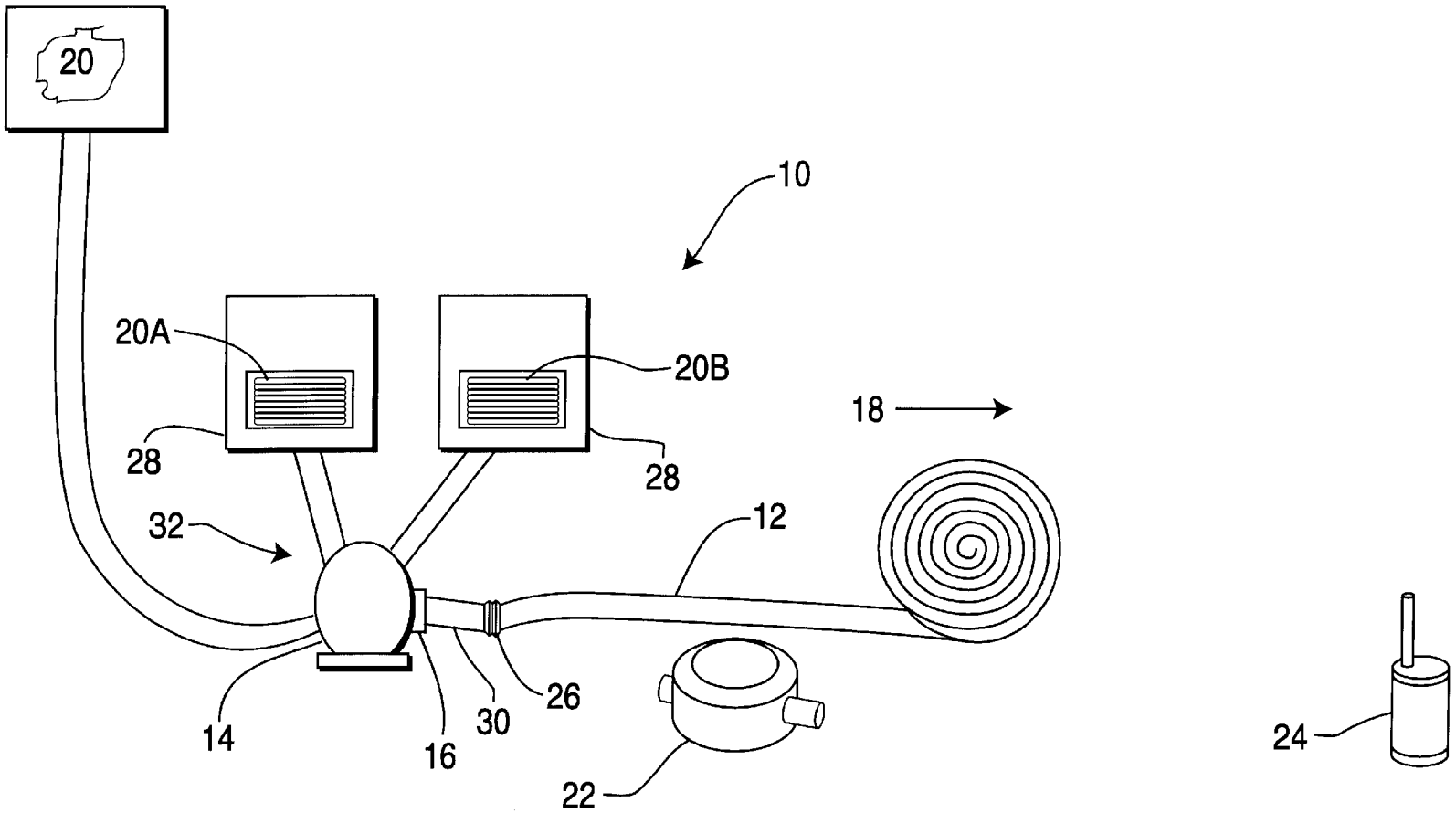
FIG. 1 illustrates the present invention prior to deployment into a mine field.

With reference to FIG. 1, the wide-area mine clearance device 10 comprises a flexible hose 12 which is attached to a pump system 14. A fitting 16 connects the hose 12 to the pump system 14. Once the hose 12 is attached to the pump system 14 using the fitting 16, the pump system 14 pumps a gas such as atmospheric air into the hose 12, which extends the hose 12 in a direction 18 away from the pump system 14. After the hose 12 is extended, the pump system 14 pumps an explosive composition 20 into and through the extended hose 12, thereby filling the hose 12 with the explosive composition 20.

The hose 12 of the present invention comprises a flexible light-weight structure capable of being placed in a rolled or folded configuration. The flexible light-weight structure of the hose 12 allows for easy storage and transport. The hose 12 is preferably plastic or fabric, but may be of any composition known in the art permitting the hose 12 to be placed in a rolled or fan folded configuration. The hose 12 also has resilience not to crack or tear in the rolled or folded configuration and strength to withstand deployment forces. The hose 12 has a length which is sufficient to extend through the area of mines to be cleared. This length is a distance that allows the mine clearance device 10 to neutralize mines in an area. The length generally extends at least as far as the furthest two mines 22 and 24 along a transit path within the minefield, but may be varied by the explosive composition 20 used, depth of the mines in relationship to the hose 12, and the like.

The circumference of the hose 12 is an amount which is capable of conducting a continuous detonation therethrough. Failure of the hose 12 to have an adequate diameter will retard the explosive effect of the explosive composition 20 and diminish its usefulness in clearing mines. The hose 12 provides an adequate diameter throughout the length of the hose 12. Generally the minimum hose 12 diameter increases with a decrease in explosive sensitivity, and is additionally affected by other factors such as water depth pressures, and the like, the affect of various factors known to those skilled in the art.

The hose 12 further comprises baffles 26 along the length of the hose 12. These baffles 26 are used to obstruct and eliminate any accidental detonation of the explosive composition 20 back into the pump system 14. Accidental detonations of the pressurized hose 12 may occur along the length of the hose 12 during deployment due to a mine exploding, non-regular explosive composition flow, and the like. The baffles 26 are composed of one or more sequential perforated discs of non-aligned perforations in a section of the hose 12 which provides a frangible or venting wall. The baffles 26 provide a deflection or obturation of any premature shock wave or back explosive flash traveling to the pump system 14. Baffles 26 increase the operational safety of deploying the device 10 by stopping an explosive flash from traveling back into an explosive composition 20 reservoir 28, prior to disconnection of the reservoir 28 from the hose 12.

The hose 12 comprises a length of tubing having one or more feed ends 30. The feed end 30 allows air to enter and extend the hose 12, and further allows the slurry explosive composition 20 to be pumped into the hose 12. The feed end 30 is configured to connect with and disconnect from the pump system 14 with the fitting 16.

Explosive composition 20 comprises explosive materials which are capable of flow within the hose 12. The explosive composition 20 comprises a slurry mixture which may be any explosive composition 20 which is effective for clearing mines. The slurry mixture generally comprises a solid explosive suspended in a fluidic carrier. The fluidic carrier is used to transport the solid explosive into the hose 12 prior to detonation. For safety reasons, the explosive composition 20 may be a binary composition, comprising a composition 20A and composition 20B, which permits safe handling of the composition prior to detonation. Generally, binary explosives and related mixing equipment are commercially available from companies such as Explosive Corporation of America (EXCOA) of Issaquah, Wash.; and Ireco Incorporated of Salt Lake, Utah. Preferably the explosive compositions 20 comprise ammonium nitrate, fuel-oil and aluminum slurries. More preferably, the explosive composition 20 is a water resistant slurry type blasting agent (SBA) using organic sensitizers and/or metallic sensitizers. Optionally, the explosive composition 20 may contain modifiers which change the explosive composition 20 characteristics for flow, water permeability, and sensitivity, with the proper type and amount of modifier being determinable by those skilled in the art. The explosive composition 20 may also contain enhancers which provide a gelatination of the explosive composition 20, making the explosive composition 20 impermeable to water. Enhancers include thickeners such as carbomers and the like. Waterproofers may be used to keep the water out of the explosive composition 20, which include colloidal forming materials, which include materials such as natural or synthetic gums, water insoluble fibers in solid or colloidal states, and the like.

Organic sensitizers minimize water content within the explosive composition 20. Additionally, organic sensitizers may waterproof the explosive composition 20. Organic sensitizers include such materials as monomethylamine nitrate and the like. Metallic sensitizers advance the explosive reaction within the explosive composition 20, and may be used as a waterproofing materials. Metallic sensitizers include such materials as granulated aluminum and the like. Preferably the explosive composition 20 comprises approximately thirty-five percent or less metallic sensitizers.

Preferably, the detonation velocity of the explosive composition 20 is relatively slow. Lower detonation velocities provide more efficient mine clearing explosions. However, as the detonation velocity decreases, there may be a comparable decrease in released energy, measured in kcal per gram. Accordingly, a balance must be made between the efficiency of the explosive composition 20 and its released energy.

An explosive composition 20 also may be selected accordingly to its specific gravity, particularly when used for maritime purposes. Selecting the explosive composition 20 with a specific gravity which is less than the water in which it is suspended provides an explosive which is buoyant, and accordingly the filled hose 12 containing the explosive composition 20 floats. An explosive composition 20 with a specific gravity greater than the surrounding water will, of course, sink. For example, increasing the amount of aluminum or metallic sensitizers within an explosive increases the specific gravity. As mines may either be floating on the water surface, laying on the bottom or suspended between the surface and bottom depending on the anticipated target depth or location of the maritime mines, the explosive composition 20 may be designed to gravitate to the approximate location near the mines to maximize its blasting effect. The buoyancy of the explosive composition 20 in the hose 12 varies dependent on the specific gravity of the water, specific gravity of the explosive composition 20, residual air in the hose 12, buoyancy of the hose 12, and the like, the determination of which is known to those skilled in the art. These considerations do not preclude the use of the mine clearance device 10 on land to neutralize land based mines.

The pump system 14 comprise a pump which pumps air into the hose 12, extending the hose 12, and then pumps the explosive composition 20 into and through the hose 12. The size and power of the pump system 14 varies with the resilience of the hose 12, viscosity of the explosive composition 20, amount of previously pumped air, relief valve settings, length of the hose 12 and other such factors, which are known to those skilled in the art. The pump system 14 must be capable of transferring sufficient explosive composition 20 through the length of the hose 12 for the explosive composition 20 to neutralize the area of mine hazard. Prior to entering the pump system 14, the binary components of the explosive compound 20 are mixed in a mixer 32. The pump system 14 may be pneumatic, screw-type or other pump systems known to those skilled in the art. In the preferred embodiment of the present invention, the mixer 32 forms an integral part of the pump system 14. The mixer 32 combines binary explosive components 20A and 20B, such as a solid explosive and a fluidic carrier, prior the mixed explosive being propelled through the pump system 14 and into and through the hose 12. This permits safer handling of the explosive components, and may be done remotely to further increase the safety of the mixing operation.

Figure 2:
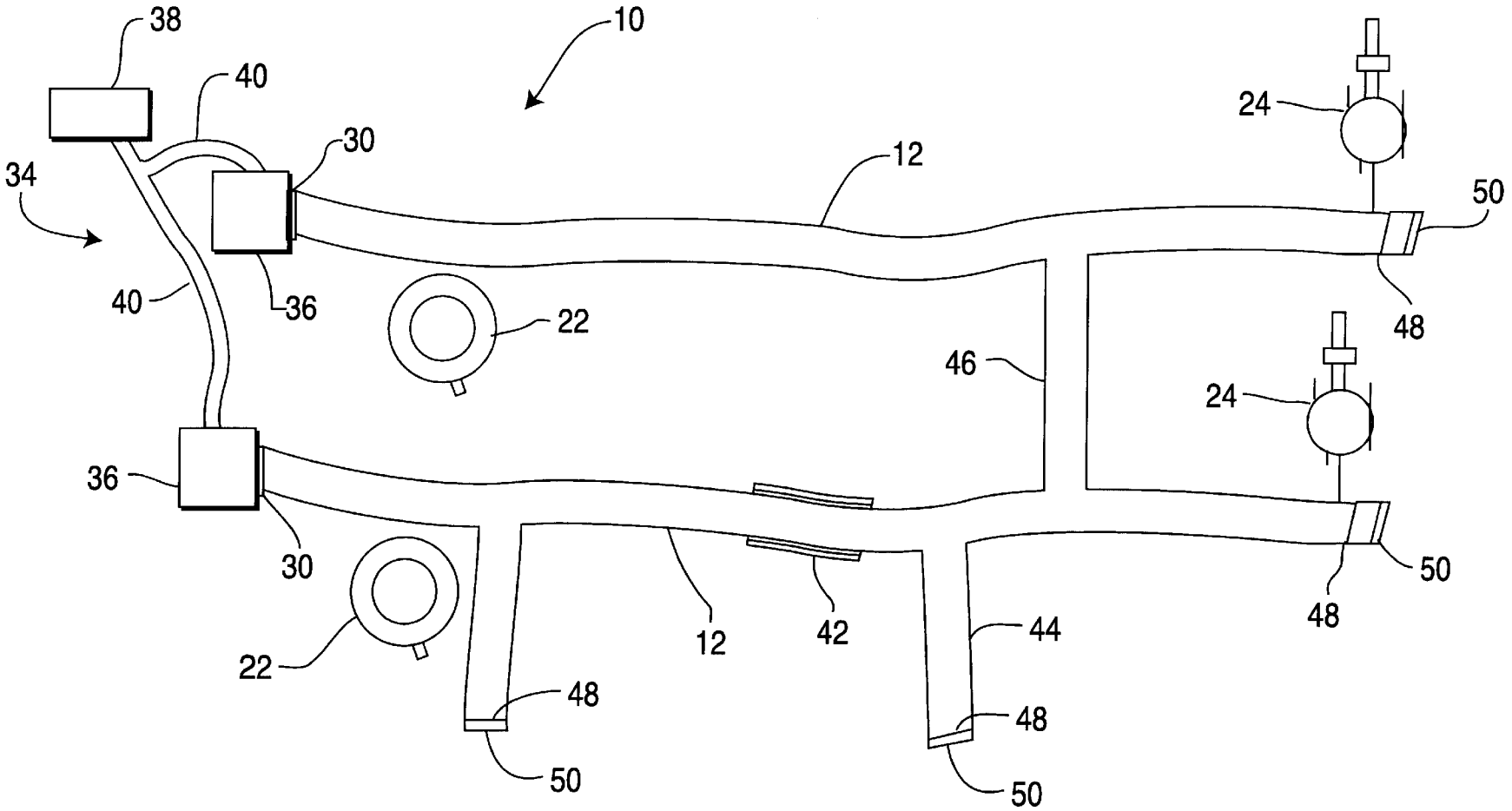
FIG. 2 illustrates multiple devices of the present invention deployed in a mine field prior to detonation.

FIG. 2 illustrates a plurality of mine clearance devices 10 which have been extended into a minefield used in conjunction with each other. Once the hose 12 is extended into the minefield and filled with the explosive composition 20, the hose 12 is removed from the pump system 14 by disconnecting fitting 16, and a detonator means 34 is connected to the hose 12 at the feed end 30. The detonation means 34 is attached to the explosive composition 20. The detonation means 34 provides an energy source in the form of a flash, shock, heat, and the like, to initiate the explosive composition 20. The amount of energy required of the detonation means 34 varies with the amount, sensitivity, physical makeup, and potential of the explosive composition 20, as well as the existing pressures within and outside of the hose 12, diameter of the hose 12 and the like. The detonation of the explosive composition 20 must be carried through the entire length of the hose 12. The detonation means 34 has a detonator 36, blasting machine 38, and initiator such as shock tubing 40.

The hose 12 may also comprise pockets 42 along the length of the hose 12. These pockets 42 are used to accumulate additional volumes of the explosive composition 20 along specific sections of the hose 12. This permits additional explosive effects along designated hose 12 sections to eliminate areas of decreased performance, known as skip zones. Additionally, the hose 12 may have a branch 44 or be otherwise networked, such as by interconnection 46, to increase the desired effect along the width or depth of the transit path. At an end of the hose 12 opposite the feed end 30, an extended end 48 has an air vent or pressure release valve 50. The pressure release valve 50 releases air from inside of the hose 12, when the pump system 14 pumps explosive composition 20 into the hose 12. The release valve 50 is set at a specified pressure which controls the exodus of the air, and further controls the ability of an operator to control the rate of the explosive composition 20 filling the hose 12.

A method for wide-area mine clearance of sea or land transit routes which provides a line of transit through a suspected area of mines, includes providing the wide-area mine clearance device 10, deploying the hose 12 within the suspected area of mines, pumping the explosive composition 20 into the hose 12 using the pump system 14 and attaching the detonator 36. The hose 12 may be pressurized with air to extend the hose 12 prior to pumping the explosive composition 20 into the hose 12 when this facilitates the deployment of the wide-area mine clearance device 10. Pressurizing the hose 12 with air prior to pumping explosive composition 20 into the hose 12 is particularly applicable in maritime environments using an explosive composition 20 with a specific gravity greater than the surrounding water. Without initially pumping air into the hose 12, the hose 12 would sink prior to and during the pumping of the explosive composition 20 into the hose 12. As such, the hose 12 would unroll underwater, having to overcome the water drag forces resisting the unrolling procedure. This necessitates the use of a more powerful and larger pump system 14 to transport the explosive composition 20 into the hose 12, which increases the danger of an accidental explosion. With previously pumped air in the hose 12, the hose 12 unrolls onto the surface of the water, and does not encounter the excessive drag forces caused by the resistance of the water as the hose 12 unrolls underneath the water surface. Air pumping equipment, gas cylinders or gas generator cylinders may be used to deploy the hose 12 to pump or release sufficient gases into the hose 12. Gas generator cylinders are available from companies such as Long-Airdox Co. of Oakhill, W.Va.

Figure 3:
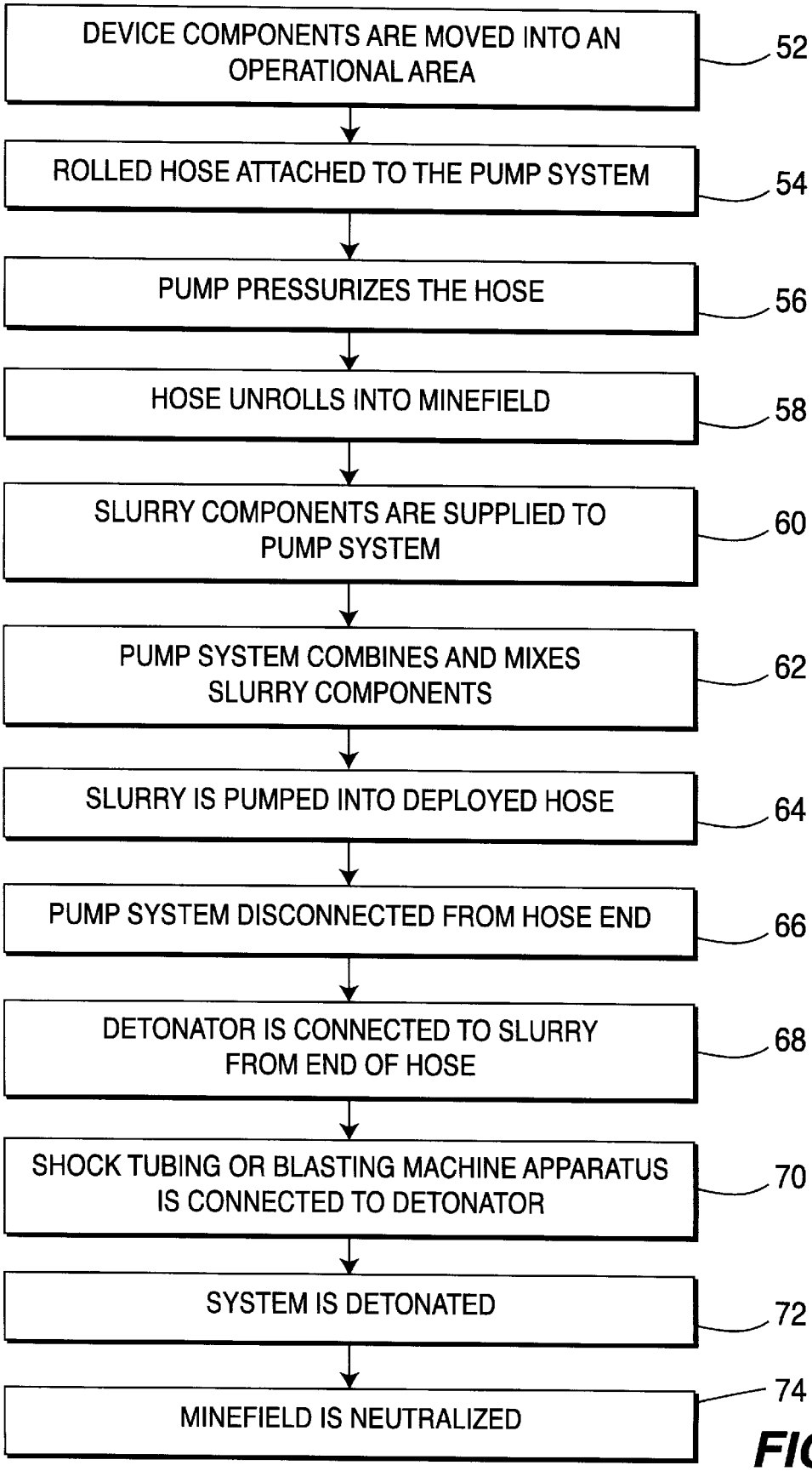
FIG. 3 is a schematic diagram for the operation of the device.

FIG. 3 is a schematic representation of the preferred embodiment for the method for wide-area mine clearance using the device 10. In operation, the wide-area mine clearance device 10 is moved 52 into an area of suspected mines, such as a navigable sea channel using a barge. The barge is moved to the area with a rolled hose 12, pump system 14, mixer 32, explosive composition 20 having binary components 20A and 20B, detonator 36, and shock tubing 40. The rolled hose 12 is attached 54 to the pump system 14, and the pump system 14 then pressurizes 56 the hose 12 with a compressible fluid, such as air. This unrolls 58 the hose 12 forward into the minefield, allowing it to remain on the surface of the water in an inflated condition in the area of the minefield. Explosive slurry components 20A and 20B, which are stored in separate containers, are supplied 60 to the mixer 32, which combines and mixes 62 the components forming a slurry explosive composition 20. The mixed slurry explosive composition 20 is transferred from the mixer 32 to the pump system 14, which pumps 64 the slurry under pressure into the deployed flexible hose 12. Pressure release valves 50 on the hose 12 permit the air to escape as the hose 12 is filled with the slurry explosive composition 20, thereby allowing the hose 12 to fill with the slurry without excessive back pressure building up in the hose 12 as the slurry enters. Once the hose 12 is filled with the slurry, the pump system 14 is disconnected 66 from the feed end 30 of the hose 12. The detonator 36 is placed on the feed end 30 of the hose 12, and connected 68 in such a way as to permit detonation of the slurry from a safe distance. A safe distance from the explosive composition 20 is any distance which provides a reasonable degree of safety to personnel operating the mine clearance device 10, which includes protective areas, barriers and other structures in which personnel may be located. Shock tubing 40 and/or other blasting machine 38 apparatus is connected 70 to the detonator 36. The detonator 36 is energized and the wide-area mine clearance device 10 is detonated 72 from a safe distance. The resulting explosive effect and shock waves neutralize 74 the minefield, rendering the area safe for transit.

Additionally, the flexible hose 12 on of the wide-area mine clearance device 10 may be deployed by any of several means, which includes aircraft such as helicopters and fixed wing, hovercraft, minesweepers and other naval vessels and barges, ballistically such as catapults or rockets, combat swimmers, draglines, trucks, tanks or other vehicles, and the like. Once deployed, preferably the pump system 14 and explosive composition 20 are isolated for safety considerations, such as being located on an unmanned barge. The wide-area mine clearance device 10 may be used in navigable sea lanes or channels, coastal areas, land or any other area of transit.

The wide-area mine clearance device 10 may be used together, or with other similar devices, to provide flexibility in creating lines of transit through sea, littoral, and land routes in suspected areas of mines. By having multiple wide-area mine clearance devices 10 used together, larger areas may be cleared with greater efficiency. When multiple flexible hoses 12 are deployed together, the explosive compositions 20 may be detonated sequentially or simultaneously. Sequential detonation provides flexibility for timing clearance of an area. Simultaneous detonation provides enhanced explosive neutralization performance and increased efficient wide-area clearance. Multiple flexible hoses 12 also permit mine clearance of wider areas and for non-straight or irregular paths of transit. The multiple flexible hoses 12 may be interconnected or placed close to one another.

The device 10 and method of the present invention allow an efficient and accurate wide-area dispersal of explosive slurry throughout a sea, littoral, or land mine field, as well as an even distribution of the explosive composition 20, or when desired, areas of concentrated amounts of explosive composition 20. Additionally, the wide-area mine clearance device 10 uses commercial blasting agent, SBAs or insensitive explosive material, such as binary explosives, to be mixed and pumped, reducing cost associated with handling, shipping and storage of hazardous/explosive materials. Safety is increased with a binary system, as with remote deployment and detonation of the device. Slurries of aluminized ANFO and other SBAs provide a cost savings and the advantage of increased supply availability over conventional military explosives.

While there have been described what are presently believed to be preferred embodiments of the present invention, those skilled in the art will realize that changes and modifications may be made thereto without departing from the spirit of the invention. It is intended that the claims attached hereto include all such changes and modifications that fall within the true scope of the invention.

What is claimed is:

1. A wide-area mine clearance device, comprising:

a flexible hose having pockets along the hose for accumulating additional volumes of an explosive composition and a length sufficient to extent through a suspected area of mines and having a circumference capable of conducting a continuous detonation therethrough:

a pump system attachable to the hose, the pump system having a pump capable of pumping an explosive composition into and through the extended hose, wherein the explosive composition fills the length of the hose;

the explosive composition comprising a slurry having a solid explosive suspended in a fluidic carrier, the fluidic carrier being capable of transporting the solid explosive;

means for extending the hose into and through a suspected area of mines; and, means for detonation of the explosive composition, wherein the explosive composition and hose are capable of conducting a continuous detonation therethrough.

* * * * *